US010737520B2

(12) United States Patent
Yoneyama et al.

(10) Patent No.: US 10,737,520 B2
(45) Date of Patent: Aug. 11, 2020

(54) THERMAL TRANSFER SHEET

(71) Applicant: Dai Nippon Printing Co., Ltd., Tokyo (JP)

(72) Inventors: Yasushi Yoneyama, Tokyo (JP); Hiroyuki Yamashita, Tokyo (JP)

(73) Assignee: Dai Nippon Printing Co., Ltd., Shinjuku-Ku (JP)

( * ) Notice: Subject to any disclaimer, the term of this patent is extended or adjusted under 35 U.S.C. 154(b) by 0 days.

(21) Appl. No.: 15/750,261

(22) PCT Filed: Jun. 6, 2016

(86) PCT No.: PCT/JP2016/066725

§ 371 (c)(1),
(2) Date: Feb. 5, 2018

(87) PCT Pub. No.: WO2017/029859

PCT Pub. Date: Feb. 23, 2017

(65) Prior Publication Data

US 2018/0229528 A1 Aug. 16, 2018

(30) Foreign Application Priority Data

Aug. 20, 2015 (JP) ..... 2015-163064

(51) Int. Cl.
*B41M 5/382* (2006.01)
*B41M 5/44* (2006.01)
*B41M 5/52* (2006.01)

(52) U.S. Cl.
CPC ..... *B41M 5/38214* (2013.01); *B41M 5/44* (2013.01); *B41M 5/5236* (2013.01);
(Continued)

(58) Field of Classification Search
CPC .... B41M 5/382; B41M 5/38214; B41M 5/44; B41M 5/52; B41M 5/5236;
(Continued)

(56) References Cited

U.S. PATENT DOCUMENTS 4,923,848 A 5/1990 Akada et al.
5,275,912 A * 1/1994 Riley ..... G03F 3/108 430/200

(Continued)

FOREIGN PATENT DOCUMENTS

CN 101060994 A 10/2007
JP S62-238791 A1 10/1987

(Continued)

OTHER PUBLICATIONS

International Search Report and Written Opinion (Application No. PCT/JP2016/066725) dated Aug. 16, 2016.

*Primary Examiner* — Gerard Higgins
(74) *Attorney, Agent, or Firm* — Burr & Brown, PLLC

(57) ABSTRACT

There is provided a thermal transfer sheet having satisfactory transferability when a transfer layer is transferred on a transfer receiving article over a wide energy range.
A thermal transfer sheet 100 for obtaining a thermal transfer image-receiving sheet includes a substrate 1 and a transfer layer 10 provided on the substrate, wherein the transfer layer 10 has a layered structure in which two or more layers are layered, the transfer layer 10 includes at least a receiving layer 2, the layer located nearest to the substrate 1 of the layers constituting the transfer layer 10 is the receiving layer 2, and the receiving layer 2 contains a cellulosic resin.

3 Claims, 4 Drawing Sheets

(52) U.S. Cl.
CPC ..... *B41M 2205/30* (2013.01); *B41M 2205/32* (2013.01); *B41M 2205/38* (2013.01)

(58) Field of Classification Search
CPC ..... B41M 2205/10; B41M 2205/30; B41M 2205/32; B41M 2205/38
USPC ..... 428/2.51, 32.77–32.79
See application file for complete search history.

(56) References Cited

U.S. PATENT DOCUMENTS

| | | | |
|---|---|---|---|
| 5,278,130 | A | 1/1994 | Arita et al. |
| 5,418,207 | A | 5/1995 | Asajima et al. |
| 6,316,385 | B1 | 11/2001 | Usuki et al. |
| 2007/0292801 | A1 | 12/2007 | Onishi et al. |

FOREIGN PATENT DOCUMENTS

| | | | |
|---|---|---|---|
| JP | H04-296595 | A1 | 10/1992 |
| JP | H05-238166 | A1 | 9/1993 |
| JP | H05-278351 | A1 | 10/1993 |
| JP | H05-294081 | A1 | 11/1993 |
| JP | H06-122281 | A1 | 5/1994 |
| JP | H07-112572 | A1 | 5/1995 |
| JP | H08-099473 | A1 | 4/1996 |
| JP | H09-039422 | A1 | 2/1997 |
| JP | H09-277672 | A1 | 10/1997 |
| JP | 2001-105747 | A1 | 4/2001 |
| WO | 2006/033452 | A1 | 3/2006 |

* cited by examiner

THERMAL TRANSFER SHEET

BACKGROUND OF THE INVENTION

1. Field of the Invention

The present invention relates to a thermal transfer sheet, specifically relates to a thermal transfer sheet used for obtaining a thermal transfer image-receiving sheet.

2. Description of Related Art

As a device for forming a printed product on a transfer receiving article without restriction, an intermediate transfer medium in which a transfer layer including a protective layer and a receiving layer are layered on a substrate in this order from the substrate side has been used (for example, Patent Literature 1). According to this intermediate transfer medium, a printed product where a thermally transferable image has been formed on a transfer receiving article can be obtained by forming the thermally transferable image on a receiving layer located on the outermost surface of the intermediate transfer medium by means of a thermal transfer sheet having a colorant layer, and then transferring the receiving layer on which the thermally transferable image has been formed together with a protective layer onto the optional transfer receiving article.

Instead of the form of usage employing the above intermediate transfer medium, there is a demand to form a thermally transferable image on the receiving layer after the transfer layer including the receiving layer is transferred onto a transfer receiving article, without forming the thermally transferable image on the receiving layer in advance of transferring the transfer layer. For example, some optional transfer receiving articles may have a hologram image or thermally transferable image (hereinbelow, such hologram images or thermally transferable images are collectively referred to as patterns of the transfer receiving article) on their surface in advance. In the case where the transfer layer of the above intermediate transfer medium is transferred onto this transfer receiving article, a pattern formed on the receiving layer constituting the transfer layer transferred onto the transfer receiving article is superposed on the pattern of the transfer receiving article to thereby form an overlay image. Depending on the form of usage of the printed product, there is a demand to obtain, not such an overlay image, a printed product in which the pattern of the transfer receiving article is masked while a thermally transferable image is formed on the masked portion. Under these circumstances, there has been proposed a thermal transfer sheet in which a portion of the pattern of the transfer receiving article is masked while a thermally transferable image can be formed on the pattern masked (for example, Patent Literature 2).

The thermal transfer sheet proposed in Patent Literature 2 is provided with a transfer layer in which a transparent receiving layer (hereinbelow, the layer is referred to as the receiving layer) and a white masking layer (hereinbelow, the layer is referred to as the masking layer) are layered in this order on a substrate. This thermal transfer sheet, in which the receiving layer is not located on the outermost surface of the thermal transfer sheet in advance of transferring the transfer layer, fails to form a thermally transferable image. However, it is possible to form a thermally transferable image on the transfer layer by transferring the transfer layer onto a transfer receiving article. Specifically, the receiving layer is allowed to be located on the outermost surface after the transfer layer is transferred by transferring the transfer layer onto a portion of the transfer receiving article. This enables the thermally transferable image to be formed on the receiving layer. Additionally, this transfer layer includes a masking layer. Thus, by transferring the transfer layer onto a transfer receiving article, it is possible to obtain a thermal transfer image-receiving sheet which masks the pattern of the transfer receiving article by the masking layer included in the transfer layer while capable of forming a thermally transferable image on the masked portion. Then, by forming a thermally transferable image on the receiving layer of the thermal transfer image-receiving sheet obtained, it is possible to obtain a printed product in which an optional pattern of the transfer receiving article is masked while the thermally transferable image is formed on the masked portion.

Incidentally, in order to form a thermally transferable image on the receiving layer constituting the transfer layer after the transfer layer is transferred, it is necessary to allow the layer located nearest to the substrate of the layers constituting the transfer layer to be the receiving layer. In other words, it is necessary to locate the receiving layer on the outermost surface when the transfer layer is transferred onto a transfer receiving article. This is because it is not possible to form a thermally transferable image on the receiving layer included in the transfer layer in the case where the layer located on the outermost surface is not the receiving layer after transferring when the transfer layer is transferred onto the transfer receiving article.

CITATION LIST

Patent Literature

Patent Literature 1: Japanese Patent Laid-Open No. 62-238791 A

Patent Literature 2: Japanese Patent Laid-Open No. 6-122281 A

SUMMARY OF THE INVENTION

Technical Problem

The market is now highly demanding printers highly suitable for high-speed printing. To satisfy this demand, it is necessary to increase thermal energy applied to a thermal transfer sheet when a transfer layer including a receiving layer is transferred onto a transfer receiving article. As described above, in order to form the thermally transferable image on the receiving layer included in the transfer layer after the transfer layer including the receiving layer is transferred, it is necessary to allow the layer located nearest to the substrate of the layers constituting the transfer layer to be the receiving layer. In order to improve the transferability of the transfer layer, it is necessary to improve the transferability of the receiving layer itself. However, as thermal energy applied to the thermal transfer sheet is increased, the transferability of the receiving layer tends to decrease. In the case where high thermal energy is applied to the thermal transfer sheet in order to transfer the transfer layer, thermal fusion between the substrate and the transfer layer occurs, in other words, the substrate is thermally fused to the receiving layer. Then, transfer defects are likely to occur, such as one in which it is not possible to peel the transfer layer from the substrate, and one in which the transfer layer, which is to be originally peeled off at the interface with the substrate, is peeled between layers constituting the transfer layer, and thus, all or a portion of the receiving layer, which is to be transferred onto a transfer receiving article, remains on the substrate side.

The present invention has been made in view of the above-mentioned circumstances, and the present invention aims principally to provide a thermal transfer sheet having satisfactory transferability when a transfer layer is transferred over a wide energy range.

Solution to Problem

The present invention for solving the above problems is a thermal transfer sheet for obtaining a thermal transfer image-receiving sheet, comprising a substrate and a transfer layer provided on the substrate, wherein the transfer layer has a layered structure in which two or more layers are layered, the transfer layer includes at least a receiving layer, the layer located nearest to the substrate of the layers constituting the transfer layer is the receiving layer, and the receiving layer contains a cellulosic resin.

The transfer layer may also be a transfer layer including a receiving layer and a masking layer layered in this order from the substrate side. Between the receiving layer and the masking layer, an intermediate layer may be further provided.

The cellulosic resin may be one or both of a cellulose acetate butyrate resin and a cellulose acetate propionate resin.

Alternatively, the transfer layer and a dye layer may be provided on the same surface of the substrate successively in a surface by surface manner.

Advantageous Effects of Invention

According to the thermal transfer sheet of the present invention, it is possible to make the transferability satisfactory when the transfer layer including a receiving layer is transferred over a wide energy range.

BRIEF DESCRIPTION OF DRAWINGS

FIG. 6(*b*) is a schematic sectional view illustrating one example of a thermal transfer image-receiving sheet of one embodiment.

FIG. 6(*c*) is a schematic sectional view illustrating one example of a thermal transfer image-receiving sheet of one embodiment.

FIG. 7(*b*) is a schematic sectional view illustrating one example of a printed product of one embodiment.

DETAILED DESCRIPTION OF THE INVENTION

<<Thermal Transfer Sheet>>

Figure 1:
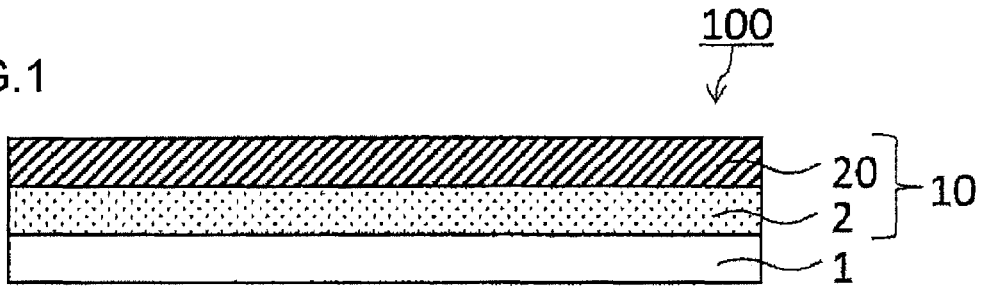
FIG. 1 is a schematic sectional view illustrating one example of a thermal transfer sheet of one embodiment.
Figure 2:
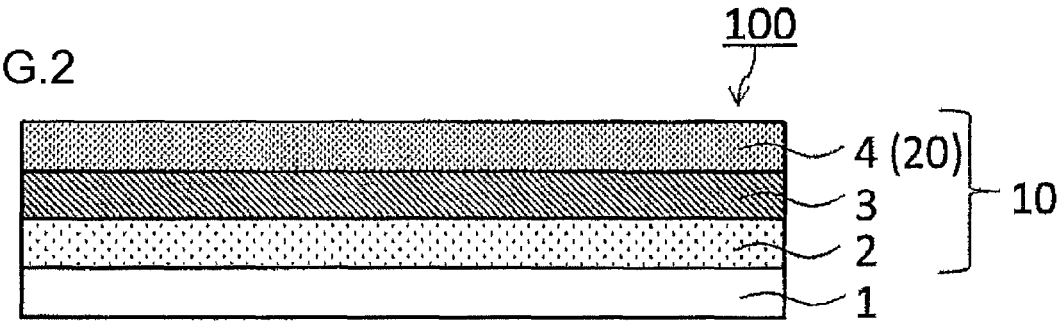
FIG. 2 is a schematic sectional view illustrating one example of a thermal transfer sheet of one embodiment.

As shown in FIG. 1 and FIG. 2, thermal transfer sheet 100 of one embodiment of the present invention (hereinbelow, the sheet is referred to as the thermal transfer sheet of one embodiment) includes a substrate 1 and a transfer layer 10 peelable from the substrate 1. The transfer layer 10, provided on the substrate 1, has a layered structure in which two or more layers including a receiving layer 2 are layered. The receiving layer 2 is located nearest to the substrate 1 of the layers constituting the transfer layer 10. In the embodiment shown in each figure, a function layer 20 is provided on the receiving layer 2.

The thermal transfer sheet 100 of one embodiment is a thermal transfer sheet used for obtaining a thermal transfer image-receiving sheet. The thermal transfer image-receiving sheet is for forming a thermally transferable image by transferring the transfer layer 10 containing the receiving layer 2 onto an optional transfer receiving article (hereinbelow, the article is referred to as a transfer receiving article), wherein the receiving layer 2 is located on the outermost surface.

As one of thermal transfer sheets including the receiving layer, an intermediate transfer medium is known in which the receiving layer located on the outermost surface is provided transferably (peelably) from the substrate. According to the intermediate transfer medium in which the receiving layer is located on the outermost surface, it is possible to form a thermally transferable image on the receiving layer without transferring the receiving layer onto a transfer receiving article. In other words, it is possible to form a thermally transferable image on the outermost surface of the intermediate transfer medium. That is, the intermediate transfer medium also serves as a thermal transfer image-receiving sheet. After the thermally transferable image is formed on the receiving layer, by transferring the receiving layer including this thermally transferable image formed thereon onto a transfer receiving article, there is obtained a printed product in which the receiving layer including the thermally transferable image formed thereon is provided on the transfer receiving article. Incidentally, as one examples of the intermediate transfer medium, an intermediate transfer medium is also known wherein an exfoliate layer (the layer may be also referred to as a protective layer) and a receiving layer are provided on a substrate in this order and the exfoliate layer can be transferred together with the receiving layer onto a transfer receiving article.

As shown in each figure, in the thermal transfer sheet 100 of one embodiment, the receiving layer 2 is not located on the outermost surface of the thermal transfer sheet 100 (in the embodiment shown in each figure, the function layer 20 is located on the outermost surface), and thus, it is not possible to form a thermally transferable image on the outermost surface of the thermal transfer sheet 100 of one embodiment. Meanwhile, in the thermal transfer sheet 100 of one embodiment, the receiving layer 2 is located nearest to the substrate 1 of the layers constituting the transfer layer 10, and thus, it is possible to locate the receiving layer 2 on the outermost surface by transferring the transfer layer 10 onto a transfer receiving article. That is, by transferring the transfer layer 10 onto a transfer receiving article, a thermal transfer image-receiving sheet in which the receiving layer 2 is located on the outermost surface can be obtained, and a thermally transferable image can be formed on the obtained thermal transfer image-receiving sheet.

In summary, the thermal transfer sheet 100 of one embodiment and the intermediate transfer medium are common in the viewpoint that the receiving layer can be transferred. However, in advance of transferring the receiving layer, the thermal transfer sheet of one embodiment and the intermediate transfer medium are different with respect to whether the thermally transferable image can be formed or not, in other words, whether the layer located on the outermost surface is the receiving layer or not. Incidentally, in the field of intermediate transfer media, a plurality of layers that includes a receiving layer and can be transferred from the substrate may be collectively referred to as "transfer layers", but, as described above, the "transfer layer" referred to in the thermal transfer sheet of one embodiment and the "transfer layer" referred to in the field of intermediate transfer media" are distinctly different with respect to whether the receiving layer is located on the outermost surface or not. Next, the respective constituents of the thermal transfer sheet 100 of one embodiment will be specifically explained.

(Substrate)

The substrate 1 is an essential constituent in the thermal transfer sheet 100 of one embodiment, and it is provided in order to support the transfer layer 10 provided on one surface of the substrate 1 or an optional layer provided between the substrate 1 and the transfer layer 10 (for example, an optional release layer described below) and a back face layer optionally provided on the other surface of the substrate 1. There is no particular limitation with respect to the material of the substrate 1, but the material desirably endures the heat applied when the transfer layer 10 is transferred onto the transfer receiving article and has a mechanical strength to the extent of being able to handle without a hitch. As the substrate 1 like this, various plastic films or sheets such as polyesters such as polyethylene terephthalate, polycarbonate, polyimide, polyether imide, cellulose derivatives, polyethylene, polypropylene, polystyrene, acryl, polyvinyl chloride, polyvinylidene chloride, nylon, polyether ether ketone, and the like can be exemplified. The thickness of the substrate 1 can be appropriately set depend on the materials such that the strength and heat resistance will be suitable. The thickness is generally in the range of 2.5 μm or more and 100 μm or less.

(Transfer Layer)

Figure 3:
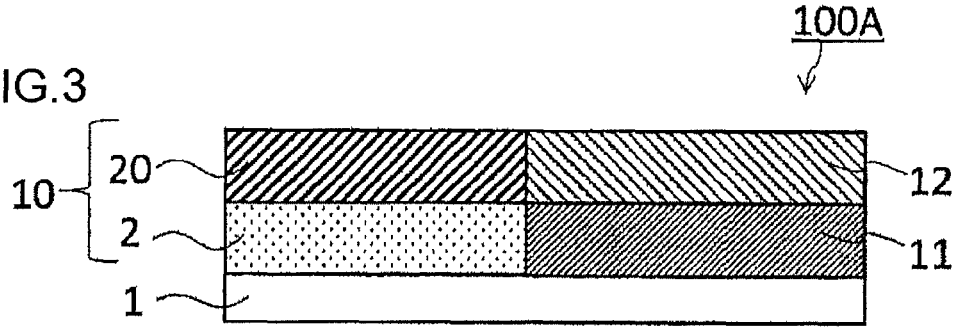
FIG. 3 is a schematic sectional view illustrating one example of a thermal transfer sheet of one embodiment.

As shown in FIGS. 1 to 3, the transfer layer 10 is provided on the substrate 1. The transfer layer 10 is provided peelably from the substrate 1 and is a layer to be transferred onto a transfer receiving article when thermally transferred. The transfer layer 10 has a layered structure in which two or more layers are layered, and includes at least a receiving layer 2. Then, it is an essential condition that, in the thermal transfer sheet 100 of one embodiment, the layer located nearest to the substrate 1 of the layers constituting the transfer layer 10 is the receiving layer 2. This is for locating the receiving layer 2 on the outermost surface of the thermal transfer image-receiving sheet obtained by transferring the transfer layer 10 including the receiving layer 2 onto a transfer receiving article.

(Receiving Layer)

It is conceived that the transferability of the transfer layer 10 when the transfer layer 10 is transferred onto a transfer receiving article is influenced by the transferability of the layer located nearest to the substrate 1 of the layers constituting the transfer layer 10, that is, the layer located on the transfer interface. Accordingly, in order to make the transferability of the transfer layer 10 satisfactory, it is necessary to sufficiently enhance the transferability of the receiving layer 2, which constitutes the transfer layer 10 and is the layer located nearest to the substrate 1.

The transferability referred to herein is an index that indicates, when the transfer layer is transferred onto the transfer receiving article side, whether it is possible to accurately transfer (migrate) the transfer layer onto the transfer receiving article side or not without leaving the transfer layer on the substrate side or without integrating the transfer receiving article with the thermal transfer sheet. That the transferability is high means that, when energy is applied to the thermal transfer sheet to thereby transfer the transfer layer onto a transfer receiving article, it is possible to accurately transfer the transfer layer onto the transfer receiving article without leaving the transfer layer corresponding to a region to which energy is applied on the substrate side or without integrating the transfer receiving article with the thermal transfer sheet. Meanwhile, that the transferability is low means that, when energy is applied to the thermal transfer sheet to thereby transfer the transfer layer onto the transfer receiving article side, in a portion of the transfer layer corresponding to the region to which energy has been applied or all the region, the substrate or a layer optionally provided on the substrate (for example, an optional release layer described below) and the transfer layer cause thermal fusion, in other words, the substrate or the layer optionally provided on the substrate and the receiving layer included in the transfer layer are thermally fused to thereby lead to integration of the transfer receiving article with the thermal transfer sheet without enabling the transfer layer to be peeled from the substrate, or the substrate or a layer optionally provided on the substrate and the receiving layer included in the transfer layer are thermally fused, the transfer layer, which is originally to be peeled off at the interface with the substrate or the layer optionally provided on the substrate, is peeled off between layers constituting the transfer layer, and thus, all or a portion of the receiving layer which is to be transferred onto the transfer receiving article remains on the substrate side.

Incidentally, the transferability of the receiving layer has not been sufficiently considered so far. In the case where a conventionally-known receiving layer is employed as the receiving layer 2 constituting the transfer layer 10, it is not possible to sufficiently satisfy the transferability of the receiving layer itself, and, as a result, the transferability of the transfer layer becomes low. Particularly, the transferability of the receiving layer tends to decrease as energy applied to the thermal transfer sheet is increased when the transfer layer is transferred.

Then, the thermal transfer sheet 100 of one embodiment is characterized in that the receiving layer 2 constituting the transfer layer 10 contains a cellulosic resin. According to the receiving layer 2 having this characteristic, it is possible to sufficiently satisfy the transferability of the receiving layer 2, which is located on the transfer interface. Even when energy applied to the thermal transfer sheet 100 is increased, it is possible to satisfy the transferability of the transfer layer 10 including the receiving layer 2. In other words, it is possible to make the transferability satisfactory when the transfer layer 10 including the receiving layer is transferred onto a transfer receiving article over a wide energy range.

As the cellulosic resin contained in the receiving layer 2, cellulose acetate resins, cellulose acetate butyrate resins, cellulose acetate propionate resins, nitro cellulose resins, cellulose acetate, and the like can be exemplified. The receiving layer 2 of an optimal embodiment contains one or both of a cellulose acetate butyrate resin and a cellulose acetate propionate resin. According to the receiving layer 2 containing a cellulose acetate butyrate resin or a cellulose acetate propionate resin, it is possible to make an improvement in the transferability of the transfer layer 10 including the receiving layer 2.

The receiving layer 2 may contain one cellulosic resin or may contain two or more cellulosic resins. The receiving layer 2 may also contain other resin in addition to the cellulosic resin.

The receiving layer 2 of an optimal embodiment contains a cellulosic resin having a number average molecule weight (Mn) of less than 70000, preferably 55000 or less, particularly preferably 40000 or less. According to the transfer layer 10 including the receiving layer 2 of an optimal embodiment, it is possible to make the foil cutting property satisfactory when the transfer layer 10 is transferred onto a transfer receiving article in comparison with a transfer layer including a receiving layer 2 only containing a cellulosic resin having a number average molecule weight (Mn) of 70000 or more as the cellulosic resin.

The receiving layer 2 may contain two or more cellulosic resin each having a different number average molecule weight (Mn). In the receiving layer 2 of an optimal embodiment, at least one cellulosic resin of the two or more cellulosic resins is a cellulosic resin having a preferable number average molecule weight (Mn) as described above. The number average molecular weight (Mn) referred to herein means a molecular weight in terms of polystyrene standard, measured by gel permeation chromatography (GPC) in compliance with JIS K7252-1:2008.

There is no particular limitation with respect to the content of cellulosic resin. With addition of an extremely small amount, for example, even in the case where the content of the cellulosic resin is set to about 0.5% by mass based on the total solid content of the receiving layer 2, it is possible to make the transferability of the transfer layer containing the receiving layer 2 satisfactory. In other words, according to the receiving layer 2 containing a cellulosic resin, regardless of its content, it is possible to make the transferability of the transfer layer including the receiving layer 2 extremely satisfactory over a wide energy range in comparison with a receiving layer not containing a cellulosic resin. This is also revealed from the results of Examples and Comparative Examples. The receiving layer of an optimal embodiment 2 contains a cellulosic resin in the range of less than 25% by mass, more preferably in the range of 1% by mass or more and less than 22% by mass based on the total solid content of the receiving layer 2. The upper limit of the content of the cellulosic resin is not particularly limited and may be 100% by mass.

Although there is no limitation with respect to the content of the cellulosic resin as described above, the content of the cellulosic resin is desirably determined in consideration of the releasability from a dye layer when a dye contained in the dye layer is allowed to migrate to thereby form a thermally transferable image on the receiving layer 2 (hereinbelow, the releasability may be referred to as dye releasability). In the case where measures to improve the dye releasability are taken on the dye layer side, for example, in the case where the dye layer contains a release agent or the like, the optional content may be used without consideration on the content of the cellulosic resin. In contrast, in the case where no measures for dye releasability are taken on the dye layer side, the content of the cellulosic resin is preferably determined depending on the type of the resin contained in the dye layer. The dye releasability in this case depends on the type of the resin contained in the dye layer. For example, in the case where the resin contained in the dye layer is a polyvinyl acetal resin or polyvinyl butyral resin and the dye layer contains no release agent, the content of the cellulosic resin is preferably less than 25% by mass based on the total solid content of the receiving layer 2. Alternatively, even in the case where neither the receiving layer 2 nor the dye layer contains a release agent and the like, use of a dye layer that contains a resin having good dye releasability from a receiving layer that contains a cellulosic resin makes the dye releasability satisfactory irrespective of the content of the cellulosic resin. That is, the content of cellulosic resin based on the total solid content of the receiving layer also can be 100% by mass. It is also possible to make an improvement in the dye releasability by allowing the receiving layer 2 to contain a release agent.

The receiving layer 2 may contain a resin other than cellulosic resins, a release agent, and the like. As the resin other than cellulosic resins, polyolefin-based resins such as polypropylene, halogenated resins such as polyvinyl chloride and polyvinylidene chloride, vinyl-based resins such as polyvinyl acetate, vinyl chloride-vinyl acetate copolymers, ethylene-vinyl acetate copolymers and polyacrylic acid esters, polyester resins, polystyrene-based resins, acryl-based resin, and the like can be exemplified.

As the release agent, solid waxes such as polyethylene wax, amide wax, and Teflon® powder, fluorine-based or phosphoric acid ester-based surfactants, silicone oils, various modified silicone oils such as reactive silicone oils and curable silicone oils, various silicone resins, and the like can be exemplified.

The receiving layer 2 may be formed by dispersing or dissolving the above-described cellulosic resin, a resin other than cellulosic resin, and additives such as a release agent, which are added if necessary, in an appropriate solvent to prepare a coating liquid for receiving layer, coating thus prepared coating liquid onto the substrate 1 or an optional layer provided on the substrate 1 in accordance with a device such as the gravure printing method, the screen printing method, the reverse roll coating method using a gravure plate, or the like, and then drying the coated liquid. There is no particular limitation with respect to the thickness of the receiving layer 2, and the thickness is usually in the range of 0.3 μm or more and 10 μm or less.

(Function Layer)

As shown in FIG. 1, a function layer 20 is provided on the receiving layer 2. The function layer 20 is an essential constituent in the thermal transfer sheet 100 of one embodiment. The function layer 20 can be appropriately selected depending on functions required from the transfer layer 10, for example, functions such as a masking property, adhesion, and the like, and there is no limitation with respect to specific functions. That is, there is not any limitation with respect to layers provided on the receiving layer 2, and any layer, if different from the receiving layer 2, may be provided. Incidentally, it is an essential condition that the thermal transfer sheet 100 of one embodiment includes the function layer 20 provided on the receiving layer 2 and the function layer 20 is located on the outermost surface of the thermal transfer sheet 100 of one embodiment. That is, it is an essential condition that the receiving layer 2 is not located on the outermost surface of the thermal transfer sheet 100 of one embodiment. The function layer 20 may have a single-layer structure or may have a layered structure. The function layer 20 will be described below with reference to one example.

The transferability of the transfer layer is influenced by the number of layers constituting the transfer layer. Usually, when the transferability of a transfer layer having a layered structure in which two or more layers are layered is compared with that of a transfer layer having a single-layer structure formed of one layer, the transferability of the transfer layer of the layered structure, which has the larger number of layers constituting the transfer layer, tends to be lower. Likewise, as the thickness of the entire transfer layer increases, the transferability of the transfer layer tends to be lower. Meanwhile, in the thermal transfer sheet 100 of one embodiment, the transfer layer 10 has a layered structure in which two or more layers are layered. However, as described above, the receiving layer 2, which is located nearest to the substrate 1 of the layers constituting the transfer layer 10, contains a cellulosic resin, and thus, an improvement in the transferability on the transfer interface has been made. Thus, according to the transfer layer 10 including the receiving layer 2 containing a cellulosic resin, in the case where the number of layers constituting the transfer layer 10 is increased by layering various function layers 20 on the receiving layer 2, or even in the case where the thickness of the entire transfer layer 10 is increased, it is possible to sufficiently satisfy the transferability of the transfer layer 10.

The function layer 20 as one example, as shown in FIG. 2, has a function of masking a portion of the surface of a transfer receiving article onto which the transfer layer 10 has been transferred. The function layer 20 having a function of masking a portion of the surface of a transfer receiving article onto which the transfer layer 10 has been transferred is referred to as a masking layer 4 hereinbelow. The masking layer 4 as one example is constituted by a binder resin and a colorant. As such a binder resin, polyester resins, urethane resins, epoxy resins, phenol resins, acryl resins, vinyl chloride-vinyl acetate copolymer resins, and the like can be exemplified. As the colorant, known colorants such as titanium oxide, zinc oxide, carbon black, iron oxide, yellow iron oxide, ultramarine, hologram powder, aluminum powder, metallic pigments, pearl pigments, and the like can be exemplified. The masking layer 4 may contain one of these binder resins and may contain two or more of these. The same applies to the colorant.

There is no particular limitation with respect to the method for forming the masking layer 4, and the masking layer 4 may be formed by dispersing or dissolving the binder resin exemplified as above, a colorant, optionally, additives if necessary in an appropriate solvent to prepare a coating liquid for masking layer, coating thus prepared coating liquid onto the receiving layer 2 in accordance with a known coating procedure such as the gravure coating method, the roll coat method, the screen printing method, the reverse roll coating method using a gravure plate, or the like, and then drying the coated liquid.

There is no particular limitation with respect to the thickness of the masking layer 4, and the thickness may be appropriately set in consideration of the masking property by the masking layer 4. When the thickness of the masking layer 4 is less than 0.1 μm, the masking property tends to decrease. Considering this point, the thickness of the masking layer 4 is preferably 0.1 μm or more. The preferable upper value of the masking layer is not particularly limited, and it may be of the order of 5 μm.

As shown in FIG. 2, it is also possible to provide an intermediate layer 3 between the receiving layer 2 and the masking layer 4 (function layer 20) in order to improve the foil tearing property of the transfer layer 10, specifically, to suppress occurrence of tailing and character collapse when the transfer layer 10 is transferred, or to improve the adhesion between the receiving layer 2 and the masking layer 4. Tailing referred to herein means a phenomenon in which, when the transfer layer is transferred onto a transfer receiving article, the transfer layer is transferred such that the transfer layer protrudes, starting from the boundary between the transfer region and the non-transfer region of the transfer layer, onto the non-transfer region. Character collapse referred to herein means a phenomenon in which a transfer receiving region surrounded by or sandwiched between transfer regions represented as characters is transferred due to a phenomenon similar to tailing and thus the original character cannot be reproduced.

The intermediate layer 3 as one example contains, for example, a binder resin such as urethane resins, polyester resins, acryl-based resins, vinyl chloride-vinyl acetate copolymer resins, polyvinyl pyrrolidone resins, polyvinyl alcohol resin, and the like, and, as required, inorganic particles such as alumina, silica, titanium oxide, carbon black, and the like. According to the intermediate layer containing organic particles together with the binder resin, it is possible to make the foil cutting property of the transfer layer 10 including the intermediate layer 3 more satisfactory. The intermediate layer 3 of an optimal embodiment contains alumina particulates or silica particulates together with the binder resin. Particularly, the intermediate layer of an optimal embodiment contains alumina particulates derived from alumina sol and silica particulates derived from colloidal silica sol together with the binder resin. It is also possible to form the intermediate layer from organic particulates without using a binder resin.

In the case of focusing on improving the dye releasability, an intermediate layer 3 containing a water-based resin is preferably provided on the receiving layer 2. In other words, by using a coating liquid for intermediate layer prepared by dispersing or dissolving a water-based resin in a water-based solvent, an intermediate layer 3 is preferably provided on the receiving layer 2. According to the thermal transfer sheet 100 of one embodiment including the intermediate layer 3 containing a water-based resin, it is possible to make an improvement in the dye releasability. Incidentally, the "water-based resin" referred to herein means a water-soluble resin or a resin which is not insoluble in water-based solvents but can be dispersed as emulsions and dispersions in water-based solvents. As the water-based solvent, water, mixed solvents of water and alcohol, and the like can be exemplified.

As the water-soluble resin, polyvinyl pyrrolidone resins, polyvinyl alcohol resins, polyacrylic acid, polyhydroxyethyl acrylate, water-soluble (or water-dispersed) polyester resins, water-soluble (or water-dispersed) polyurethane resins, water-dispersible vinyl chloride resins, water-dispersible acryloyl chloride type resins, water-dispersible epoxy resins, gelatin, hydroxyethyl cellulose resins, hydroxypropyl cellulose resins, carboxymethyl cellulose, and the like can be exemplified.

There is no particular limitation with respect to the method for forming the intermediate layer 3, and the intermediate layer 3 may be formed by dispersing or dissolving a binder resin and optionally, additives if necessary in an appropriate solvent to prepare a coating liquid for intermediate layer, coating thus prepared coating liquid onto the receiving layer 2 in accordance with a known coating procedure such as the gravure coating method, the roll coat method, the screen printing method, the reverse roll coating method using a gravure plate, or the like, and then drying the coated liquid.

There is no particular limitation with respect to the thickness of the intermediate layer, and the thickness is preferably 0.01 μm or more and 5 μm or less, particularly preferably 0.02 μm or more and 3 μm or less.

The function layer 20, as another example, has a function of improving the adhesion between a transfer receiving article and the transfer layer 10. Hereinbelow, the function layer 20 having adhesion is referred to as the adhesive layer. As the adhesive layer, conventionally known ones in the field of the thermal transfer sheet can be appropriately selected and used. The adhesive layer as one example contains an ultraviolet absorbing copolymerized resin, an acryl-based resin, a vinyl chloride-vinyl acetate copolymer resin, an epoxy resin, a polyester resin, a polycarbonate resin, a butyral resin, a polyamide resin, a vinyl chloride resin, or the like.

There is no particular limitation with respect to the method for forming the adhesive layer, and the adhesive layer may be formed by dispersing or dissolving the binder resin exemplified as above, an ultraviolet absorbent, an antioxidant, a fluorescent brightener, an inorganic or organic filler component, a surfactant, a release agent, and the like, which are added if necessary, in an appropriate solvent to prepare a coating liquid for adhesive layer, coating thus prepared coating liquid onto the receiving layer 2 by a method such as the gravure coating method and the gravure reverse coating method, and then drying the coated liquid. There is no particular limitation with respect to the thickness of the adhesive layer, and the thickness is preferably in the range of 0.5 μm or more and 10 μm or less, more preferably in the range of 0.8 μm or more and 2.0 μm or less.

(Release Layer)

A release layer (not shown) may be provided between the substrate 1 and the transfer layer 10. The release layer, which is an optional constituent in the thermal transfer sheet 100 of one embodiment, is a layer not constituting the transfer layer 10. That is, the release layer remains on the substrate side 1 when the transfer layer 10 is transferred onto a transfer receiving article. By providing the release layer between the substrate 1 and the transfer layer 10, it is possible to make an improvement in the transferability of the transfer layer 10, along with the satisfactory transferability of the receiving layer 2 containing a cellulosic resin.

As the binder resin contained in the release layer, waxes, silicone waxes, silicone resins, modified silicone resins, fluorine resins, modified fluorine resins, polyvinyl alcohol, acryl resins, thermally cross-linkable epoxy-amino resin, thermally cross-linkable alkyd-amino resin, and the like can be exemplified. The release layer may be formed of one resin or may be formed of two or more resins. The release layer also may be formed by using a cross-linking agent such as an isocyanate compound, a catalyst such as a tin-based catalyst, an aluminum-based catalyst, or the like in addition to the releasable resin. The thickness of the release layer is generally in the range of 0.2 μm or more and 5 μm or less. The release layer may be formed by dissolving or dispersing the above-described resin in an appropriate solvent to prepare a coating liquid for release layer, coating thus prepared coating liquid onto the substrate 1 in accordance with a conventionally known procedure such as the gravure printing method, the screen printing method, the reverse coating method using a gravure plate, or the like, and then drying the coated liquid.

(Back Face Layer)

A back face layer (not shown) may be provided on the surface opposite to the surface of the substrate 1 on which the transfer layer 10 is provided. Incidentally, the back face layer is an optional constituent in the thermal transfer sheet 100 of one embodiment.

There is no limitation with respect to the material of the back face layer, and single resins or mixtures of natural or synthetic resins such as cellulosic resins, such as cellulose acetate butyrate and cellulose acetate propionate, vinyl-based resins, such as polyvinyl butyral and polyvinyl acetal, acrylic-based resins, such as polymethyl methacrylate, polyethyl acrylate, polyacrylamide, and acrylonitrile-styrene copolymers, polyamide resins, polyamide imide resins, polyester resins, polyurethane resins, and silicone-modified or fluorine-modified urethanes can be exemplified.

The back face layer may also contain a solid or liquid lubricant. As the lubricant, various waxes, such as polyethylene wax and paraffin wax, higher aliphatic alcohols, organo polysiloxanes, anionic surfactants, cationic surfactants, amphoteric surfactants, nonionic surfactants, fluorine-based surfactants, organic carboxylic acids and derivatives thereof, metal soaps, fluorine-based resins, silicone-based resins, and fine particles of inorganic compounds such as talc and silica and the like can be exemplified. The mass of the lubricant based on the total mass of the back face layer is preferably in the range of 5% by mass or more and 50% by mass or less, more preferably in the range of 10% by mass or more and 40% by mass or less.

There is no particular limitation with respect to the method for forming the back face layer, and the back face layer can be formed by preparing a coating liquid for the back face layer in which a resin, a lubricant to be added as required and the like are dissolved or dispersed in an appropriate solvent, coating the substrate 1 with the thus prepared coating liquid by a conventional coating device such as a gravure coater, a roll coater, and a wire bar, and then drying the coating liquid. The thickness of the back face layer is preferably in the range of 1 μm or more and 10 μm or less.

<<Thermal Transfer Sheet of Another Embodiment>>

Figure 4:
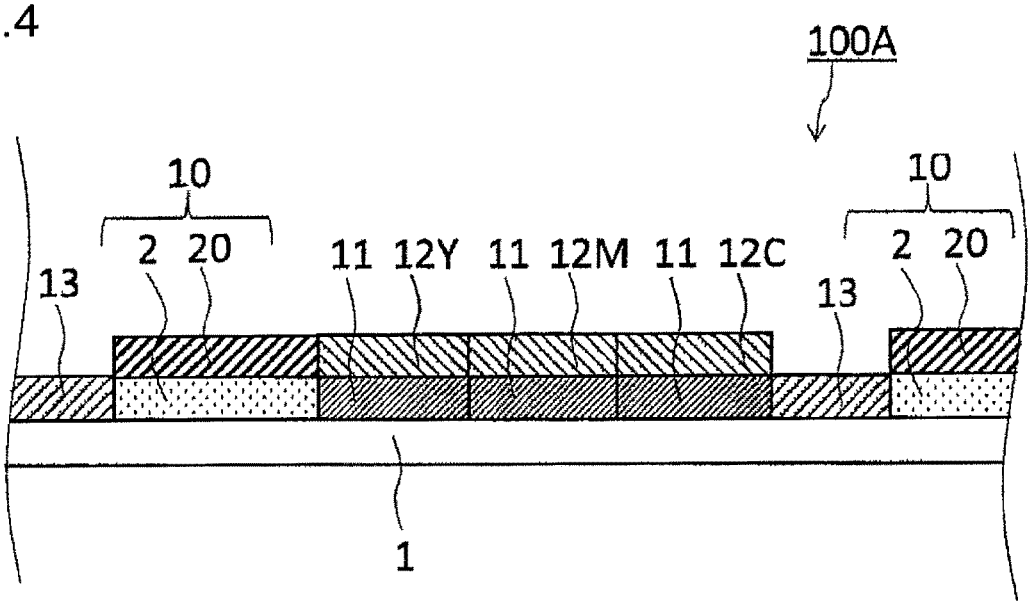
FIG. 4 is a schematic sectional view illustrating one example of a thermal transfer sheet of one embodiment.

In the thermal transfer sheet 100A of another embodiment, as shown in FIG. 3, the transfer layer 10 and the dye layer 12 are provided on the same surface of the substrate 1 successively in a surface by surface manner. In the embodiment shown, a dye primer layer 11 is provided between the substrate 1 and the dye layer 12. In other words, the thermal transfer sheet 100A of another embodiment takes a configuration where a dye layer 12 is further provided on the same surface on which the transfer layer 10 of the substrate 1 is also provided, in thermal transfer sheet 100 of one embodiment described above. In the thermal transfer sheet 100A of another embodiment shown in FIG. 3, as shown in FIG. 4, the transfer layer 10, the dye layer 12, and an optional protective layer 13 may also be provided on the same surface of the substrate 1 repeatedly and successively in a surface by surface manner. Alternatively, in an embodiment shown in FIG. 4, instead of or together with the optional protective layer 13, an optional coloring agent layer containing a pigment (not shown), an optional special color panel constituted by a hologram layer (not shown) or the like may be provided repeatedly and successively in a surface by surface manner. The order in which these optional layers are provided repeatedly and successively in a surface by surface manner is not limited to the forms shown.

Figure 5:
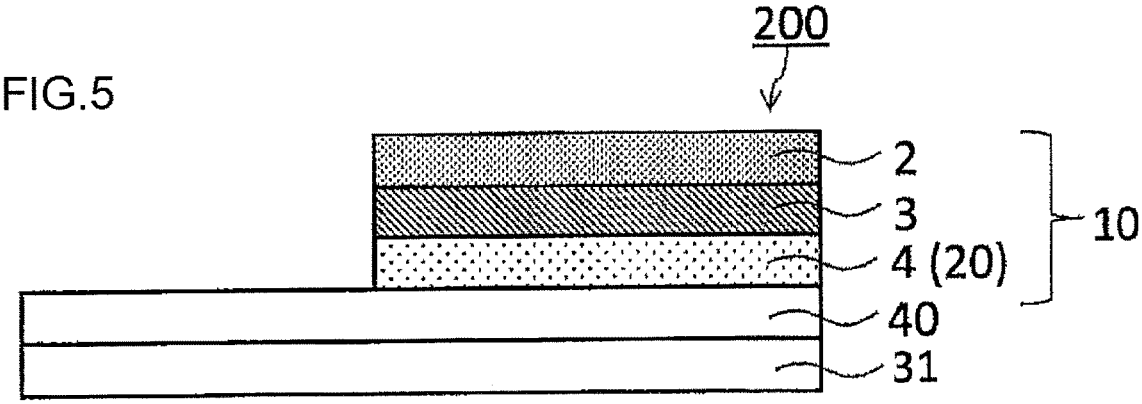
FIG. 5 is a schematic sectional view illustrating one example of a thermal transfer image-receiving sheet of one embodiment.

According to the thermal transfer sheet 100A of another embodiment, for example, it is possible to perform both formation of the thermal transfer image-receiving sheet 200 as shown in FIG. 5 and formation of a thermally transferable image onto the receiving layer 2 of the thermal transfer image-receiving sheet formed. Specifically, by transferring the transfer layer 10 onto a transfer receiving article by using the thermal transfer sheet 100A of another embodiment, a thermal transfer image-receiving sheet in which the function layer 20 and the receiving layer 2 are layered in this order on the transfer receiving article can be obtained. Additionally, transferring the dye contained in the dye layer 12 of the thermal transfer sheet 100A of another embodiment onto the receiving layer 2 of the thermal transfer image-receiving sheet 200 obtained by transferring the transfer layer 10 onto a transfer receiving article enables formation of a thermally transferable image.

Hereinafter, the respective constituents of the thermal transfer sheet 100A of another embodiment will be explained with focusing on differences between the thermal transfer sheet 100A and the thermal transfer sheet 100 of one embodiment. Unless otherwise particularly specified, ones described in the thermal transfer sheet 100 of one embodiment can be used as they are.

(Dye Layer)

The dye layer 12 contains a sublimable dye and a binder resin. In the dye layer 12, a layer of one color selected appropriately may be formed when the desired image is a monochromatic image, or a plurality of dye layers each containing a sublimable dye having a different hue, such as a yellow dye 12Y, a magenta dye 12M, and a cyan dye 12C may be repeatedly formed on the same surface of the same substrate successively in a surface by surface manner, when the desired image is a full-color image, as shown in FIG. 4. In the embodiment shown in FIG. 4, although the transfer layer 10, the yellow dye 12Y, the magenta dye 12M, the cyan dye 12C, and the protective layer 13 are repeatedly formed in this order on the same surface of the substrate, the layers may not be repeatedly formed. Alternatively, the layers may not be formed in this order. The dye layer 12 is not limited to one described hereinbelow, and a conventionally known dye layer in the field of thermal transfer sheets can be used as it is.

<<Sublimable Dye>>

There is no particular limitation with respect to the sublimable dye, and those having a sufficient color density and resistance to discoloration and fading due to light, heat, temperature and the like are preferred. As such a sublimable dye, diaryl methane-based dyes, triaryl methane-based dyes, thiazole-based dyes, merocyanine dyes, pyrazolone dyes, methine-based dyes, indoaniline-based dyes, pyrazolomethine-based dyes, azomethine-based dyes such as acetophenoneazomethine, pyrazoloazomethine, imidazoleazomethine, imidazoazomethine, and pyridoneazomethine, xanthene-based dyes, oxazine-based dyes, cyanostyrene-based dyes such as dicyanostyrene and tricyanostyrene, thiazine-based dyes, azine-based dyes, acridine-based dyes, benzeneazo-based dyes, azo-based dyes such as, pyridoneazo, thiopheneazo, isothiazoleazo, pyrroleazo, pyrazoleazo, imidazoleazo, thiadiazoleazo, triazoleazo, and disazo, spiropyran-based dyes, indolinospiropyran-based dyes, fluoran-based dyes, rhodaminelactam-based dyes, naphthoquinone-based dyes, anthraquinone-based dyes, quinophthalone-based dyes and the like can be exemplified. Specifically, red dyes such as MS Red G (manufactured by Mitsui Toatsu Chemicals Co., Ltd.), Macrolex Red Violet R (manufactured by Bayer AG), CeresRed 7B (manufactured by Bayer AG), and Samaron Red F3BS (manufactured by Mitsubishi Chemical Corporation), yellow dyes such as Holon Brilliant yellow 6GL (manufactured by Clariant), PTY-52 (manufactured by Mitsubishi Chemical Industries, Ltd.), and MACROLEX Yellow 6G (manufactured by Bayer AG), and blue dyes such as Kayaset Blue 714 (manufactured by Nippon Kayaku Co., Ltd.), Waxoline Blue AP-FW (manufactured by ICI), Holon Brilliant Blue S-R (manufactured by Sandoz), MS Blue 100 (Mitsui Toatsu Chemicals Co., Ltd.), C.I. Solvent blue 63, and the like can be exemplified.

The content of the sublimable dye is preferably in the range of 50% by mass or more and 350% by mass, more preferably in the range of 80% by mass or more and 300% by mass, based on the total solid content of the binder resin described later. When the content of the sublimable dye is less than the above range, the printing density tends to decrease. When the content of the sublimable dye exceeds the above range, the preservability and the like tend to decrease.

<<Binder Resin>>

There is no particular limitation with respect to the binder resin which is contained in the dye layer and used for carrying the above sublimable dye, and those having a certain degree of heat resistance and having a moderate affinity with the sublimable dye can be used. As such a binder resin, cellulosic resins, such as nitro cellulose, cellulose acetate butyrate, and cellulose acetate propionate, vinyl-based resins, such as polyvinyl acetate, polyvinyl butyral, and polyvinyl acetal, acryl resins such as poly(meth) acrylate and poly(meth)acrylamide, polyurethane-based resins, polyamide-based resins, polyester-based resin, and the like can be exemplified.

There is no particular limitation with respect to the content of the binder resin, but when the content of the binder resin based on the total solid content of the dye layer 12 is less than 20% by mass, it is not possible to sufficiently retain the sublimable dye in the dye layer 12, and thus the preservability tends to decrease. Therefore, the binder resin is preferably contained in an amount of 20% by mass or more based on the total solid content of the dye layer 12. There is no particular limitation with respect to the upper limit of the content of the binder resin, and the upper limit can be set as appropriate depending on the content of the sublimable dye and optional additives.

The dye layer 12 may also contain additives such as inorganic particles and organic particulates. As the inorganic particles, talc, carbon black, aluminum, molybdenum disulfide and the like can be exemplified, and as the organic particulates, polyethylene waxes, silicone resin particulates, and the like can be exemplified. The dye layer 12 may contain a release agent. Further, as the release agent, modified or non-modified silicone oils (including those called silicone resins), phosphoric acid ester, fatty acid esters, and the like can be exemplified.

There is no particular limitation with respect to the method for forming the dye layer 12, and the dye layer 12 can be formed by dispersing or dissolving the binder resin, the sublimable dye, optionally, additives if necessary and the release agent in an appropriate solvent to prepare a coating liquid for the dye layer, coating the dye primer layer 11 described later with the thus prepared coating liquid for the dye layer using a conventionally known coating device such as a gravure coater, a roll coater, and a wire bar, and then drying the coating liquid. The thickness of the dye layer is generally in the range of 0.2 μm or more and 2.0 μm or less.

(Dye Primer Layer)

Between the substrate 1 and the dye layer 12, a dye primer layer 11 intended to improve the adhesion between the substrate 1 and the dye layer 12 may be provided.

There is no particular limitation with respect to the dye primer layer 11, and a conventionally known dye primer layer in the field of thermal transfer sheet can be appropriately selected and used. One example of the dye primer layer 11 is constituted by a resin material. As the resin material constituting the dye primer layer 11, polyester-based resins, polyvinyl pyrrolidone resins, polyvinyl alcohol resins, polyacrylic acid ester-based resins, polyvinyl acetate-based resins, polyurethane-based resins, styrene acrylate-based resins, polyacrylamide-based resins, polyamide-based resins, resins such as polyvinyl acetoacetal, polyvinyl butyral, and the like can be exemplified. The dye primer layer 11 may also contain various additives such as organic particles and inorganic particles together with these resin components.

There is no particular limitation with respect to the method for forming the dye primer layer 11, and the dye primer layer may be formed by dispersing or dissolving the resin component exemplified as above and optionally, additives if necessary in an appropriate solvent to prepare a coating liquid for the dye primer layer, coating the substrate 1 with the thus prepared coating liquid using a conventionally known coating device such as the gravure coating method, the roll coat method, the screen printing method, the reverse roll coating method using a gravure plate, or the like, and then drying the coating liquid. There is no particular limitation with respect to the thickness of the dye primer layer 11, and the thickness is usually in the range of 0.02 μm or more and 1 μm or less.

<<Thermal Transfer Image-Receiving Sheet>>

Subsequently, a thermal transfer image-receiving sheet formed by using the thermal transfer sheet 100 of one embodiment described above (hereinbelow, the sheet is referred to as the thermal transfer image-receiving sheet of one embodiment) will be described with reference to one example. As shown in FIG. 5, in a thermal transfer image-receiving sheet 200 of one embodiment, a transfer layer 10 is provided on a transfer receiving article such that a receiving layer 2 is located on the outermost surface. The transfer receiving article of the embodiment shown has a structure in which a pattern layer 40 is provided on a substrate 31. Incidentally, there is no particular limitation with respect to the transfer receiving article. For example, the pattern layer 40 is an optional constituent in the thermal transfer image-receiving sheet 200 of one embodiment. In the thermal transfer image-receiving sheet 200 of the embodiment shown in FIG. 5, a masking layer 4 is used as a function layer 20 included in the transfer layer 10 in order to mask a portion of the pattern layer 40. FIG. 5 is a schematic sectional view of the thermal transfer image-receiving sheet of one embodiment. Incidentally, in the thermal transfer image-receiving sheet 200 of the embodiment shown in FIG. 5, the transfer layer 10 is provided on a transfer receiving article such that a portion of the surface of the transfer receiving article is exposed. For example, in the case where the transfer receiving article includes no pattern layer 40 or in the case where the function layer 20 is not a masking layer 4, it is possible to provide the transfer layer 10 on the transfer receiving article without exposing the surface of the transfer receiving article. The case where the transfer receiving article includes the substrate 31 and the pattern layer 40 and the function layer 20 is the masking layer 4 will be described below as an example. For convenience of explanation, the receiving layer 2 constituting the transfer layer 10 is referred to as the first receiving layer 2.

(Substrate of Thermal Transfer Image-Receiving Sheet)

There is no particular limitation with respect to the substrate 31 of the thermal transfer image-receiving sheet 200 (hereinbelow, the substrate is referred to as the substrate 31), and conventionally known substrates can be appropriately selected and used as the substrate of the thermal transfer image-receiving sheet. As the substrate 31 generally used in the field of thermal transfer image-receiving sheets, paper substrates such as wood-free paper, art paper, lightweight coated paper, lightly coated paper, coated paper, castcoated paper, synthetic resin or emulsion-impregnated paper, synthetic rubber latex-impregnated paper, and synthetic resin internally added paper can be exemplified. In addition to these, the substrate 1 described in the above thermal transfer sheet 100 of one embodiment can be used as it is.

(Pattern Layer)

The pattern layer 40 is provided on the substrate 31. The pattern layer 40 may be a layer on which some patterns are formed or a colored layer, and there is no limitation with respect to the pattern on the pattern layer 40.

Figure 6A:
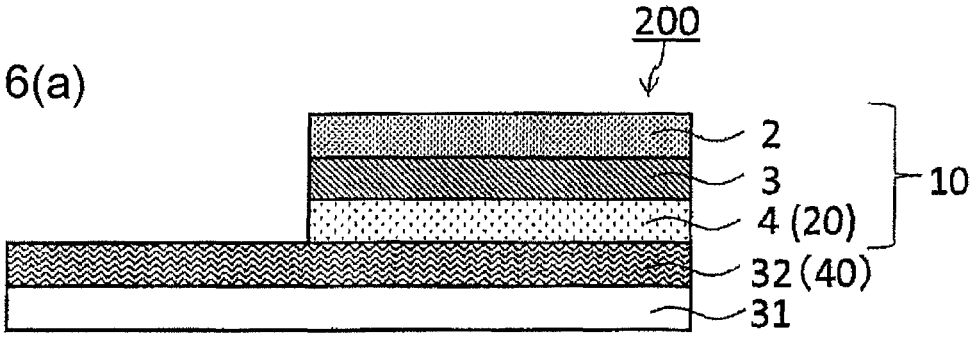
FIG. 6(*a*) is a schematic sectional view illustrating one example of a thermal transfer image-receiving sheet of one embodiment.
Figure 6B:
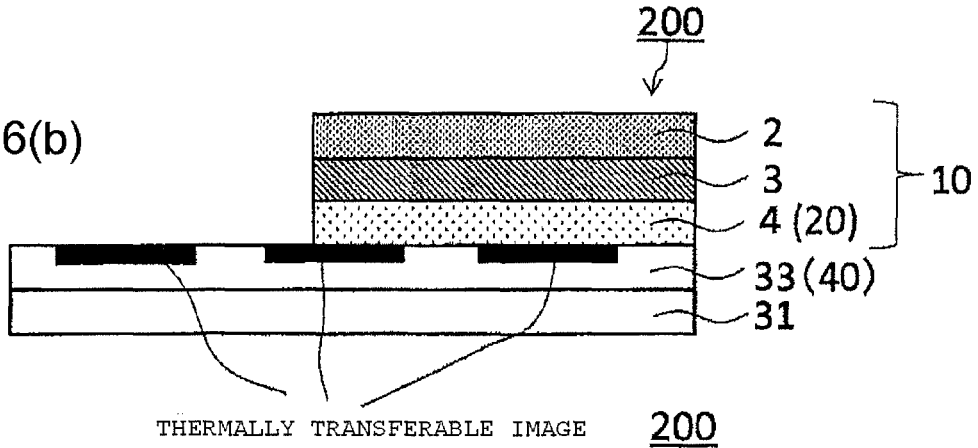
Figure 6C:
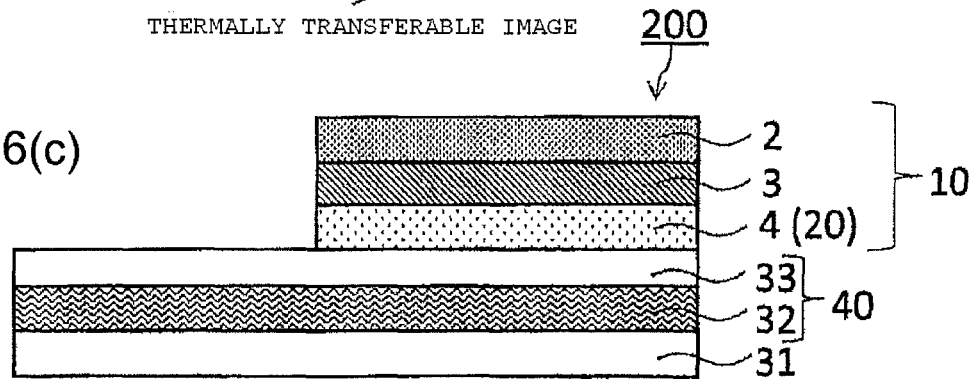

For example, as shown in FIG. 6(*a*), a conventionally known hologram layer 32 may be used as the pattern layer 40, or as shown in FIG. 6(*b*), a second receiving layer 33 on which a thermally transferable image is formed may be used as the pattern layer 40, or as shown in FIG. 6(*c*), a laminate in which the hologram layer 32 and the second receiving layer 33 are layered from the substrate 31 side may be used as the pattern layer 40. The second receiving layer 33 in FIG. 6(*c*) is a receiving layer before a thermally transferable image is formed, but may be a receiving layer on which a thermally transferable image has been formed in advance. Using the second receiving layer 33 as the receiving layer before formation of a thermally transferable image enables formation of a thermally transferable image onto the first receiving layer 2 as well as formation of a thermally transferable image onto the second receiving layer 33. There is no limitation with respected to the second receiving layer 33, and conventionally known receiving layers can be appropriately selected and used as the receiving layer of the thermal transfer image-receiving sheet. For example, the receiving layer 2 described in the above thermal transfer sheet 100 of one embodiment can be used as it is. As the hologram layer 32, for example, a layer having an uneven pattern (interference fringes) or a sheet onto which a hologram as commercially available is formed may be used, and layers including a colored hologram such as gold-colored one, silver-colored one or the like colored by metal deposition may also be used. FIGS. 6(*a*) to (*c*) are schematic sectional views of the thermal transfer image-receiving sheet of one embodiment.

As the transfer layer 10, those described with respect to the thermal transfer sheet 100 of one embodiment described above can be appropriately selected and used, and a detailed description for the sheet is omitted here.

There is no particular limitation with respect to the method for forming the thermal transfer image-receiving sheet 200 of one embodiment. For example, the sheet 200 can be obtained, using the thermal transfer sheet 100 of one embodiment described above, by transferring the transfer layer 10 onto the substrate 31 including a pattern layer 40 provided on the surface such that a portion of the surface of the pattern layer 40 is exposed.

<<Method for Forming Printed Product>>

Subsequently, the method for forming a printed product by using the thermal transfer sheet 100 of one embodiment (hereinbelow, the method is referred to as the method for forming a printed product of one embodiment) will be described. The method for forming a printed product of one embodiment comprises a step of providing a transfer receiving article and the thermal transfer sheet of another embodiment described above, a step of transferring the transfer layer of the thermal transfer sheet provided in the providing step onto the transfer receiving article provided in the providing step, and a step of forming a thermally transferable image on the transfer layer transferred on the transfer receiving article.

(Step of Providing Thermal Transfer Sheet)

As the thermal transfer sheet provided in the present step, the thermal transfer sheets of another embodiment described above can be used as they are, and a detailed description for the sheet is omitted here.

As the transfer receiving article, the substrate 31 described with respect to the thermal transfer image-receiving sheet 200 of one embodiment described above, a transfer receiving article including a pattern layer 40 provided on the substrate 31, or the like can be exemplified. For example, the substrate 31, the pattern layer 40, and the like described in the above thermal transfer image-receiving sheet 200 of one embodiment may be appropriately selected to form a transfer receiving article including the pattern layer provided on the substrate. This pattern layer 40 includes a pattern layer 40 in which a thermally transferable image is finally formed to provide a pattern. Specifically, the pattern layer 40 may be a receiving layer before a thermally transferable image is formed.

(Step of Transferring)

The present step is a step of transferring the transfer layer of the thermal transfer sheet provided in the above providing step onto a transfer receiving article provided in the same providing step. A thermal transfer image-receiving sheet formed by transferring the transfer layer onto the transfer receiving article is obtained via the present step. In other words, the above thermal transfer image-receiving sheet of one embodiment is obtained. In the case where the transfer receiving article includes a pattern layer 40, the transfer layer 10 may be transferred such that a portion of the surface of the pattern layer is exposed.

According to the thermal transfer sheet provided in the above providing step, since the receiving layer 2 contains a cellulosic resin, it is possible to transfer the transfer layer, with good transferability, onto the transfer receiving article in the step of transferring the transfer layer.

(Step of Forming Thermally Transferable Image)

The present step is a step of forming a thermally transferable image by allowing a sublimable dye to diffuse and transfer onto the receiving layer of the thermal transfer image-receiving sheet obtained in the transferring step described above. For example, a printed product in which the masking layer, the intermediate layer, and the receiving layer are provided in this order on the transfer receiving article having the pattern layer such that a portion of the pattern layer is exposed and a thermally transferable image is formed on the receiving layer is obtained via the present step.

As the thermal transfer sheet for allowing the sublimable dye to diffuse and transfer, in the case where the thermal transfer sheet provided in the providing step described above is the thermal transfer sheet 100A of another embodiment comprising the dye layer 12 described above, this thermal transfer sheet can be used as it is. Alternatively, in the case where the thermal transfer sheet provided in the providing step described above is the thermal transfer sheet 100 of one embodiment described above not comprising the dye layer 12, a conventionally known thermal transfer sheet comprising a dye layer containing a sublimable dye may be used.

Figure 7A:
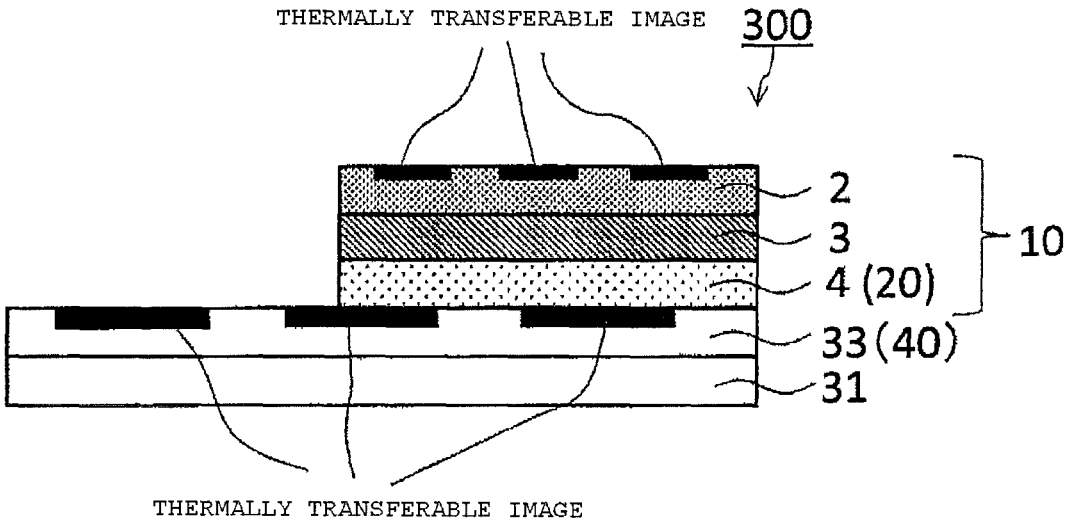
FIG. 7(*a*) is a schematic sectional view illustrating one example of a printed product formed by a method for forming a printed product of one embodiment.
Figure 7B:
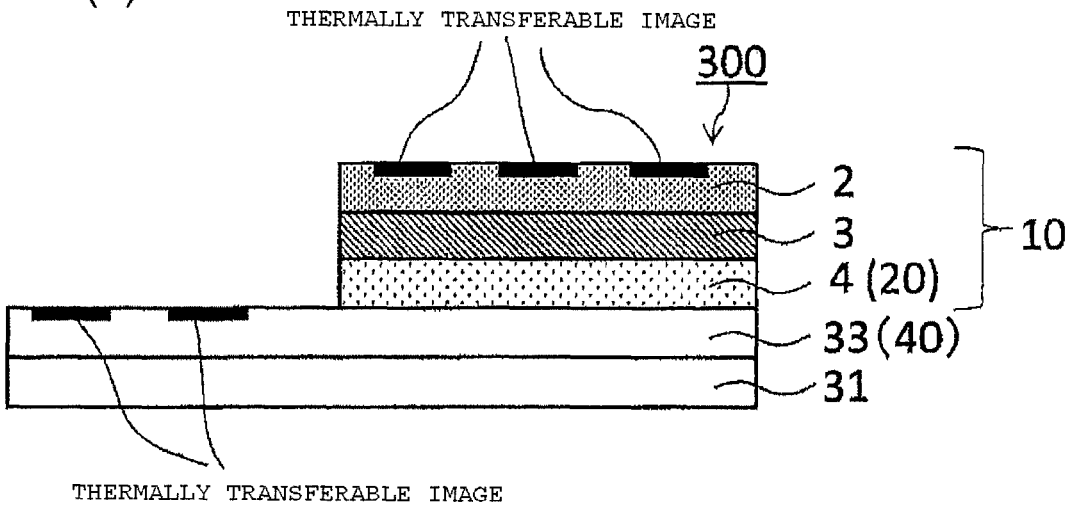

FIG. 7 is a schematic sectional view illustrating one example of a printed product 300 formed by the method for forming a printed product of one embodiment. In the case where the pattern layer 40 of the transfer receiving article provided in the providing step is the second receiving layer 33 including a thermally transferable image formed in advance, a thermally transferable image is formed on the receiving layer 2 in the step of forming a thermally transferable image, and, as shown in FIG. 7(*a*), a printed product 300 in which a portion of the pattern layer 40 is masked by the masking layer 4 and a thermally transferable image is formed on the masking layer is obtained. In contrast, in the case where the pattern layer 40 of the transfer receiving article provided in the providing step is the second receiving layer 33 before a thermally transferable image is formed, in the step of forming a thermally transferable image, the thermally transferable image is formed on the second receiving layer 33 of the transfer receiving article of which surface is exposed and the thermally transferable image is formed also on the receiving layer 2, and thus, a printed product 300 of the embodiment shown in FIG. 7(*b*) is obtained. The pattern layer 40 is not limited to the embodiment shown, and various forms of the pattern layer 40 described in the thermal transfer image-receiving sheet 200 of one embodiment can be appropriately selected and used.

In the method for forming a printed product of one embodiment described hereinabove, the receiving layer 2 constituting the transfer layer of the thermal transfer sheet provided in the providing step contains a cellulosic resin. This can make the transferability satisfactory when the transfer layer 10 is transferred onto a transfer receiving article. Specifically, it is possible to make the transferability satisfactory when the transfer layer is transferred onto a transfer receiving article over a wide energy range. Alternatively, use of the thermal transfer sheet of another embodiment enables formation of a thermally transferable image by means of one thermal transfer sheet.

<<Printed Product>>

Subsequently, a printed product 300 formed by using the thermal transfer sheet 100 of one embodiment described above (hereinbelow, the printed product is referred to as the printed product of one embodiment) will be described. As shown in FIGS. 7(*a*) and (*b*), the printed product 300 of one embodiment is characterized by having a thermally transferable image formed on the first receiving layer 2 of the thermal transfer image-receiving sheet 200 of one embodiment described above.

EXAMPLES

Next, the present invention will be described more concretely with demonstrating examples. Unless otherwise specified below, the "part" and "%" are based on the mass. For components having a solid component ratio, a mass value in terms of solid content is indicated.

Example 1

Using a polyethylene terephthalate film of 5 μm in thickness as a substrate, the substrate was coated with a coating liquid for the back face layer having the following composition so as to reach 1.0 g/m$^2$ in a dried state, and a back face layer was formed. Then, the surface of the substrate opposite to the surface on which the back face layer was provided was coated with a coating liquid 1 for the first receiving layer having the following composition so as to reach 1.0 g/m$^2$ in a dried state, and a first receiving layer was formed. Then, the first receiving layer was coated with a coating liquid for the first intermediate layer having the following composition so as to reach 0.15 g/m$^2$ in a dried state, and a first intermediate layer was formed. Then, the first intermediate layer was coated with a coating liquid for the masking layer having the following composition so as to reach 2.0 g/m$^2$ in a dried state, and a masking layer was formed. Thus, the thermal transfer sheet of Example 1 was obtained, wherein the transfer layer including the first receiving layer, the first intermediate layer, and the masking layer layered in this order was provided on one surface of the substrate and the back face layer was provided on the other surface of the substrate.

<Coating Liquid for the Back Face Layer>

| | |
|---|---|
| Polyvinyl butyral resin (S-LEC BX-1, SEKISUI CHEMICAL CO., LTD.) | 1.8 parts |
| Polyisocyanate (BURNOCK D750, DIC Corporation) | 5.5 parts |
| Phosphoric acid ester-based surfactant (PLYSURF A208N, DKS Co. Ltd.) | 1.6 parts |
| Talc (MICRO ACE P-3, NIPPON TALC Co., Ltd.) | 0.35 parts |
| Toluene | 18.5 parts |
| Methyl ethyl ketone | 18.5 parts |

<Coating Liquid 1 for the First Receiving Layer>

| | |
|---|---|
| Vinyl chloride-vinyl acetate copolymer resin (SOLBIN CNL, Nissin Chemical Co., Ltd.) | 15.8 parts |
| Cellulose acetate butyrate resin (Mn: 30000) (CAB381-0.5, Eastman Chemical Company) | 1.0 part |
| Silicone oil (X-22-3000T, Shin-Etsu Chemical Co., Ltd.) | 1.2 parts |
| Silicone oil (X-24-510, Shin-Etsu Chemical Co., Ltd.) | 1.2 parts |
| Silicone oil (KF-352A, Shin-Etsu Chemical Co., Ltd.) | 0.8 parts |
| Methyl ethyl ketone | 40 parts |
| Toluene | 40 parts |

<Coating Liquid for the First Intermediate Layer>

| | |
|---|---|
| Colloidal alumina (solid content 10.5%) (Alumina sol 200, Nissan Chemical Industries, Ltd.) | 3.5 parts |
| Vinyl acetate-vinyl pyrrolidone copolymer (PVP/VA E-335, ISP Japan Ltd.) | 1.5 parts |
| Water/isopropyl alcohol mixed solvent (1:1) | 95 parts |

<Coating Liquid for the Masking Layer>

| | |
|---|---|
| Acrylic-based resin | 3 parts |
| Vinyl chloride-vinyl acetate copolymer resin | 1 part |
| Titanium oxide | 16 parts |
| Methyl ethyl ketone | 40 parts |
| Toluene | 40 parts |

Example 2

The thermal transfer sheet of Example 2 was obtained totally in the same manner as in Example 1 except that the first receiving layer was formed by using a coating liquid 2 for the first receiving layer in which 1.0 part of cellulose acetate butyrate resin (CAB381-0.5, Eastman Chemical Company) (Mn: 30000) in the coating liquid 1 for the first receiving layer was replaced by 1.0 part of cellulose acetate butyrate resin (Mn: 20000) (CAB381-0.1, Eastman Chemical Company), instead of the coating liquid 1 for the first receiving layer.

Example 3

The thermal transfer sheet of Example 3 was obtained totally in the same manner as in Example 1 except that the first receiving layer was formed by using a coating liquid 3 for the first receiving layer in which 1.0 part of cellulose acetate butyrate resin (CAB381-0.5, Eastman Chemical Company) (Mn: 30000) in the coating liquid 1 for the first receiving layer was replaced by 1.0 part of cellulose acetate butyrate resin (Mn: 40000) (CAB381-2, Eastman Chemical Company), instead of the coating liquid 1 for the first receiving layer.

Example 4

The thermal transfer sheet of Example 4 was obtained totally in the same manner as in Example 1 except that the first receiving layer was formed by using a coating liquid 4 for the first receiving layer in which 1.0 part of cellulose acetate butyrate resin (CAB381-0.5, Eastman Chemical Company) (Mn: 30000) in the coating liquid 1 for the first receiving layer was replaced by 1.0 part of cellulose acetate butyrate resin (Mn: 30000) (CAB551-0.2, Eastman Chemical Company), instead of the coating liquid 1 for the first receiving layer.

Example 5

The thermal transfer sheet of Example 5 was obtained totally in the same manner as in Example 1 except that the first receiving layer was formed by using a coating liquid 5 for the first receiving layer in which 1.0 part of cellulose acetate butyrate resin (CAB381-0.5, Eastman Chemical Company) (Mn: 30000) in the coating liquid 1 for the first receiving layer was replaced by 1.0 part of cellulose acetate butyrate resin (Mn: 12000) (CAB321-0.1, Eastman Chemical Company), instead of the coating liquid 1 for the first receiving layer.

Example 6

The thermal transfer sheet of Example 6 was obtained totally in the same manner as in Example 1 except that the first receiving layer was formed by using a coating liquid 6 for the first receiving layer in which 1.0 part of cellulose acetate butyrate resin (CAB381-0.5, Eastman Chemical Company) (Mn: 30000) in the coating liquid 1 for the first receiving layer was replaced by 1.0 part of cellulose acetate propionate resin (Mn: 25000) (CAP482-0.5, Eastman Chemical Company), instead of the coating liquid 1 for the first receiving layer.

Example 7

The thermal transfer sheet of Example 7 was obtained totally in the same manner as in Example 1 except that the coating liquid 1 for the first receiving layer was replaced by a coating liquid 7 for the first receiving layer having the following composition.

<Coating Liquid 7 for the First Receiving Layer>

| | |
|---|---|
| Vinyl chloride-vinyl acetate copolymer resin (SOLBIN CNL, Nissin Chemical Co., Ltd.) | 16.6 parts |
| Cellulose acetate butyrate resin (Mn: 30000) (CAB381-0.5, Eastman Chemical Company) | 0.2 part |
| Silicone oil (X-22-3000T, Shin-Etsu Chemical Co., Ltd.) | 1.2 parts |
| Silicone oil (X-24-510, Shin-Etsu Chemical Co., Ltd.) | 1.2 parts |
| Silicone oil (KF-352A, Shin-Etsu Chemical Co., Ltd.) | 0.8 parts |

-continued

| | |
|---|---|
| Methyl ethyl ketone | 40 parts |
| Toluene | 40 parts |

Example 8

The thermal transfer sheet of Example 8 was obtained totally in the same manner as in Example 1 except that the coating liquid 1 for the first receiving layer was replaced by a coating liquid 8 for the first receiving layer having the following composition.

<Coating Liquid 8 for the First Receiving Layer>

| | |
|---|---|
| Vinyl chloride-vinyl acetate copolymer resin (SOLBIN CNL, Nissin Chemical Co., Ltd.) | 12.8 parts |
| Cellulose acetate butyrate resin (Mn: 30000) (CAB381-0.5, Eastman Chemical Company) | 4.0 parts |
| Silicone oil (X-22-3000T, Shin-Etsu Chemical Co., Ltd.) | 1.2 parts |
| Silicone oil (X-24-510, Shin-Etsu Chemical Co., Ltd.) | 1.2 parts |
| Silicone oil (KF-352A, Shin-Etsu Chemical Co., Ltd.) | 0.8 parts |
| Methyl ethyl ketone | 40 parts |
| Toluene | 40 parts |

Example 9

The thermal transfer sheet of Example 9 was obtained totally in the same manner as in Example 1 except that the coating liquid 1 for the first receiving layer was replaced by a coating liquid 9 for the first receiving layer having the following composition.

<Coating Liquid 9 for the First Receiving Layer>

| | |
|---|---|
| Vinyl chloride-vinyl acetate copolymer resin (SOLBIN CNL, Nissin Chemical Co., Ltd.) | 11.8 parts |
| Cellulose acetate butyrate resin (Mn: 30000) (CAB381-0.5, Eastman Chemical Company) | 5.0 parts |
| Silicone oil (X-22-3000T, Shin-Etsu Chemical Co., Ltd.) | 1.2 parts |
| Silicone oil (X-24-510, Shin-Etsu Chemical Co., Ltd.) | 1.2 parts |
| Silicone oil (KF-352A, Shin-Etsu Chemical Co., Ltd.) | 0.8 parts |
| Methyl ethyl ketone | 40 parts |
| Toluene | 40 parts |

Example 10

The thermal transfer sheet of Example 10 was obtained totally in the same manner as in Example 1 except that the first receiving layer was formed by using a coating liquid 10 for the first receiving layer in which 1.0 part of cellulose acetate butyrate resin (CAB381-0.5, Eastman Chemical Company) (Mn: 30000) in the coating liquid 1 for the first receiving layer was replaced by 1.0 part of cellulose acetate butyrate resin (Mn: 70000) (CAB381-20, Eastman Chemical Company), instead of the coating liquid 1 for the first receiving layer.

Example 11

The thermal transfer sheet of Example 11 was obtained totally in the same manner as in Example 1 except that no first intermediate layer was formed between the masking layer and the first receiving layer.

Comparative Example 1

The thermal transfer sheet of Comparative Example 1 was obtained totally in the same manner as in Example 1 except that the coating liquid 1 for the first receiving layer was replaced by a coating liquid A for the first receiving layer having the following composition.

<Coating Liquid a for the First Receiving Layer>

| | |
|---|---|
| Vinyl chloride-vinyl acetate copolymer resin (SOLBIN CNL, Nissin Chemical Co., Ltd.) | 16.8 parts |
| Silicone oil (X-22-3000T, Shin-Etsu Chemical Co., Ltd.) | 1.2 parts |
| Silicone oil (X-24-510, Shin-Etsu Chemical Co., Ltd.) | 1.2 parts |
| Silicone oil (KF-352A, Shin-Etsu Chemical Co., Ltd.) | 0.8 parts |
| Methyl ethyl ketone | 40 parts |
| Toluene | 40 parts |

<Formation of Transfer Receiving Article>

Using a polyethylene terephthalate film of 25 μm in thickness as a substrate, this substrate was coated with a coating liquid for the hologram layer having the following composition by the gravure coating method so as to reach an amount for coating of 2 g/m$^2$ in a dried state. Using a metal sheet on which interference fringes of a hologram had been unevenly formed, the layer after coating was embossed to impart unevenness of the hologram thereto, and thereby a hologram layer was formed. Thereafter, on the surface of the hologram layer onto which the unevenness had been imparted, aluminum was vapor-deposited so as to obtain a thickness of 30 nm to form a reflective layer, and thus, a hologram sheet in which the substrate, the hologram layer, and the reflective layer were layered in this order was obtained.

<Coating Liquid for the Hologram Layer>

| | |
|---|---|
| Acryl resin | 40 parts |
| Melamine resin | 10 parts |
| Cyclohexanone | 50 parts |
| Methyl ethyl ketone | 50 parts |

Subsequently, using RC paper (STF-150, manufactured by Mitsubishi Paper Mills Limited, 190 μm) as a support, this support was coated with a coating liquid for the adhesive layer having the following composition by the gravure coating method so as to reach an amount for coating of 3.0 g/m$^2$ in a dried state to form an adhesive layer. The hologram sheet obtained above was laminated using the adhesive layer such that the reflective layer of the hologram sheet was opposed to the support to thereby obtain a laminate (support/adhesive layer/reflective layer/hologram layer/substrate).

<Coating Liquid for the Adhesive Layer>

| | |
|---|---|
| Polyfunctional polyol (TAKELAC A-969-V, Takeda Pharmaceutical Company Limited.) | 30 parts |
| Isocyanate (TAKELAC A-5, Takeda Pharmaceutical Company Limited.) | 10 parts |
| Ethyl acetate | 60 parts |

Subsequently, the substrate of the laminate (support/adhesive layer/reflective layer/hologram layer/substrate) obtained above was coated with a coating liquid for the second intermediate layer having the following composition by the gravure coating method so as to reach an amount for coating of 1.2 g/m$^2$ in a dried state to form a second intermediate layer. The second intermediate layer was coated with a coating liquid for the second receiving layer having the following composition by the gravure coating method so as to reach an amount for coating of 4.0 g/m$^2$ in a dried state to form the second receiving layer, and thus, the transfer receiving article in which the support/adhesive layer/reflective layer/hologram layer/substrate/second intermediate layer/second receiving layer were layered in this order was obtained.

<Coating Liquid for the Second Intermediate Layer>

| | |
|---|---|
| Water-dispersed polyester resin (solid content 25%, Tg 20° C.) (VYLONAL MD-1480, TOYOBO CO., LTD.) | 10 parts |
| Electrically conductive synthetic layer silicate (average primary particle size 25 nm) (LAPONITE JS, Wilbur-Ellis) | 10 parts |
| Water | 80 parts |

<Coating Liquid for the Second Receiving Layer>

| | |
|---|---|
| Vinyl chloride-vinyl acetate copolymer (SOLBIN C, Nissin Chemical Co., Ltd.) | 15 parts |
| Silicone (X-22-3000T, Shin-Etsu Chemical Co., Ltd.) | 0.75 parts |
| Silicone (X-24-510, Shin-Etsu Chemical Co., Ltd.) | 0.1 parts |
| Methyl ethyl ketone | 33 parts |
| Toluene | 33 parts |

(Evaluation of Transferability)

The transfer receiving article produced above was combined with the thermal transfer sheet of each of Examples and Comparative Examples. Using a printer described below, under (1) low energy conditions (150/255 gray scale) or (2) high energy conditions (255/255 gray scale), the transfer layer was transferred onto a portion of a region on the second receiving layer of the transfer receiving article produced above so as to form a fine line, and the thermal transfer image-receiving sheet of each of Examples and Comparative Examples was obtained. The transferability when the transfer layer was transferred under energy conditions (1) or (2) was evaluated based on the following evaluation criteria. Evaluation results are shown in Table 1.

(Printer)

Thermal head: KEE-57-12GAN2-STA (manufactured by KYOCERA Corporation

Heater average resistance: 3303 (Ω)

Main scanning direction printing density: 300 dpi

Sub scanning direction printing density: 300 dpi

Printing voltage: 18 (V)

One line cycle: 1.5 (msec.)

Printing start temperature: 35 (° C.)

Pulse-Duty ratio: 85%

"Evaluation Criteria"

○: The transfer layer in a region to which heat has been applied is entirely transferred onto the transfer receiving article.

x: A portion of the transfer layer in a region to which heat has been applied remains on the substrate side.

(Evaluation of Foil Tearing Property)

The condition of the transfer layer in the thermal transfer image-receiving sheet of each example obtained by transferring the transfer layer under the above (1) low energy conditions (150/255 gray scale) was visually observed, and the foil tearing property of the transfer layer was evaluated based on the following evaluation criteria. Evaluation results are shown in Table 1.

"Evaluation Criteria"

○: The 5-dot fine line is transferred and there is no collapse in the 5-dot-dropped fine line.

x: Tailing occurs around the 5-dot fine line.

Alternatively, the 5-dot-dropped fine line is completely collapsed.

(Production of Thermal Transfer Sheet (i))

Using a polyethylene terephthalate film of 5 μm in thickness as a substrate, this substrate was coated with a coating liquid for the back face layer having the above composition so as to reach 1.0 g/m$^2$ in a dried state, and a back face layer was formed. Then, the other surface of the substrate was coated with a coating liquid for the dye primer layer having the following composition so as to reach 0.15 g/m$^2$ in a dried state, and a dye primer layer was formed. This dye primer layer was coated with coating liquids for yellow and magenta dye layer having the above composition successively in a surface by surface manner so as to reach 0.7 g/m$^2$ in a dried state to form a yellow dye layer and a magenta dye layer, and a thermal transfer sheet (i) was obtained.

<Coating Liquid for the Dye Primer Layer>

| | |
|---|---|
| Colloidal alumina (solid content 10.5%) (Alumina sol 200, Nissan Chemical Industries, Ltd.) | 3.5 parts |
| Vinyl acetate-vinyl pyrrolidone copolymer (PVP/VA E-335, ISP Japan Ltd.) | 1.5 parts |
| Water/isopropyl alcohol mixed solvent (1:1) | 95 parts |

<Coating Layer for Yellow Dye Layer>

| | |
|---|---|
| Solvent yellow 93 | 5 parts |
| Polyvinyl acetoacetal resin (KS-5, SEKISUI CHEMICAL CO., LTD.) | 4 parts |
| Toluene | 50 parts |
| Methyl ethyl ketone | 50 parts |

<Coating Liquid for the Magenta Dye Layer>

| | |
|---|---|
| Disperse Red 60 | 3 parts |
| Disperse Violet 26 | 3 parts |
| Polyvinyl acetoacetal resin (KS-5, SEKISUI CHEMICAL CO., LTD.) | 5 parts |
| Toluene | 50 parts |
| Methyl ethyl ketone | 50 parts |

(Dye Releasability Evaluation)

A red image was formed by printing in the order of yellow and magenta under 255/255 gray scale conditions onto the first receiving layer of the thermal transfer image-receiving sheet of each of Examples and Comparative Examples obtained by transferring a transfer layer having a size of 70 mm×70 mm under the above (1) low energy conditions (150/255 gray scale). During formation of this red image, the release force when the magenta dye layer of the thermal transfer sheet (i) was released from the first receiving layer was measured under the following conditions and evaluated based on the release force of Comparative Example 1, in comparison with that of other Examples and Comparative Example. Evaluation results are shown in Table 1.

(Measurement Conditions for Release Force)
Release equipment: Surface Property Tester HEIDON-14 manufactured by Shinto Scientific Co., Ltd.
Release speed: 200 mm/minute
Width of specimen to be measured: 70 mm
Release angle: 180°
"Evaluation Criteria"
○: Twice or less of the reference value
x: More than twice the reference value

TABLE 1

| | Receiving layer | Inter- | Transferability | | Dye | Foil |
|---|---|---|---|---|---|---|
| | Content (%) (*1) | mediate layer | Low energy | High energy | releas-ability | tearing property |
| Example 1 | 5 | Yes | ○ | ○ | ○ | ○ |
| Example 2 | 5 | Yes | ○ | ○ | ○ | ○ |
| Example 3 | 5 | Yes | ○ | ○ | ○ | ○ |
| Example 4 | 5 | Yes | ○ | ○ | ○ | ○ |
| Example 5 | 5 | Yes | ○ | ○ | ○ | ○ |
| Example 6 | 5 | Yes | ○ | ○ | ○ | ○ |
| Example 7 | 1 | Yes | ○ | ○ | ○ | ○ |
| Example 8 | 20 | Yes | ○ | ○ | ○ | ○ |
| Example 9 | 25 | Yes | ○ | ○ | x | ○ |
| Example 10 | 5 | Yes | ○ | ○ | ○ | x |
| Example 11 | 5 | No | ○ | ○ | x | ○ |
| Comparative Example 1 | 0 | Yes | ○ | x | Refer-ence | — |

(*1) The content of the cellulosic resin based on the total mass of the receiving layer

REFERENCE SIGNS LIST

100, 100A Thermal transfer sheet
1 Substrate
2 Receiving layer, first receiving layer
3 Intermediate layer
4 Masking layer
10 Transfer layer
11 Dye primer layer
12 Dye layer
12Y Yellow dye layer
12M Magenta dye layer
12C Cyan dye layer
200 Thermal transfer image-receiving sheet
20 Function layer
31 Substrate
32 Hologram layer
33 Second receiving layer
40 Pattern layer
300 Printed product

The invention claimed is:

1. A thermal transfer sheet for obtaining a thermal transfer image-receiving sheet, the thermal transfer sheet comprising:
a substrate; and
a transfer layer provided on the substrate,
wherein the transfer layer has a layered structure in which two or more layers are layered,
wherein the transfer layer comprises at least a receiving layer,
wherein the receiving layer is a layer of the layers constituting the transfer layer located nearest to the substrate,
wherein the receiving layer comprises a cellulosic resin, the cellulosic resin being at least one of a cellulose acetate butyrate resin and a cellulose acetate propionate resin,
wherein a content of the cellulosic resin in the receiving layer is in a range of at least 1% by mass to less than 22% by mass based on a total solid content of the receiving layer, and
wherein the receiving layer further comprises a vinyl chloride-vinyl acetate copolymer.

2. A thermal transfer sheet for obtaining a thermal transfer image-receiving sheet, the thermal transfer sheet comprising:
a substrate; and
a transfer layer provided on the substrate,
wherein the transfer layer has a layered structure in which two or more layers are layered,
wherein the transfer layer comprises at least a receiving layer,
wherein the receiving layer is a layer of the layers constituting the transfer layer located nearest to the substrate,
wherein the receiving layer comprises a cellulosic resin, the cellulosic resin being at least one of a cellulose acetate butyrate resin and a cellulose acetate propionate resin,
wherein a content of the cellulosic resin in the receiving layer is in a range of at least 1% by mass to less than 22% by mass based on a total solid content of the receiving layer,
wherein the transfer layer comprises the receiving layer and a masking layer, layered in this order from the substrate side, and
wherein the receiving layer further comprises a vinyl chloride-vinyl acetate copolymer.

3. A thermal transfer sheet for obtaining a thermal transfer image-receiving sheet, the thermal transfer sheet comprising:
a substrate; and
a transfer layer provided on the substrate,
wherein the transfer layer has a layered structure in which two or more layers are layered,
wherein the transfer layer comprises at least a receiving layer,
wherein the receiving layer is a layer of the layers constituting the transfer layer located nearest to the substrate,
wherein the receiving layer comprises a cellulosic resin, the cellulosic resin being at least one of a cellulose acetate butyrate resin and a cellulose acetate propionate resin,
wherein a content of the cellulosic resin in the receiving layer is in a range of at least 1% by mass to less than 22% by mass based on a total solid content of the receiving layer,
wherein the transfer layer comprises the receiving layer and a masking layer, layered in this order from the substrate side, wherein an intermediate layer is further provided between the receiving layer and the masking layer, and
wherein the receiving layer further comprises a vinyl chloride-vinyl acetate copolymer.

* * * * *